United States Patent [19]

Zalotay

[11] 4,102,097

[45] Jul. 25, 1978

[54] CONSTRUCTION FOR SUPPORTING SPACE UNITS INSTALLED IN A BUILDING ESPECIALLY A MULTI-STOREY BUILDING

[76] Inventor: Elemer Zalotay, Cacilienstrasse 34, Bern 3007, Switzerland

[21] Appl. No.: 687,734

[22] Filed: May 19, 1976

Related U.S. Application Data

[63] Continuation-in-part of Ser. No. 526,328, Dec. 23, 1974, abandoned.

[51] Int. Cl.[2] ..... E04H 9/02

[52] U.S. Cl. ..... 52/167; 52/79.12

[58] Field of Search ..... 52/167, 283, 573, 79, 52/236; 428/15, 17, 20–22

[56] References Cited

U.S. PATENT DOCUMENTS

| | | | |
|---|---|---|---|
| 981,884 | 1/1911 | Ruhl | 52/167 |
| 2,212,142 | 8/1940 | Austin | 248/22 |
| 3,363,370 | 1/1968 | Camoletti | 52/236 |
| 3,396,502 | 8/1968 | Contevita | 52/236 |
| 3,691,712 | 9/1972 | Bowling | 52/573 |
| 3,721,052 | 3/1973 | Boëh | 52/236 |
| 3,758,998 | 9/1973 | Ollis | 52/236 |
| 3,977,140 | 8/1976 | Masahara | 52/167 |

FOREIGN PATENT DOCUMENTS

| | | | |
|---|---|---|---|
| 56,921 | 4/1970 | German Demo. Rep. | 52/236.6 |
| 2,152,134 | 4/1973 | Fed. Rep. of Germany | 52/236 |
| 2,457,380 | 9/1975 | Fed. Rep. of Germany | 52/79 |
| 6,801,193 | 8/1968 | Netherlands | 52/236 |
| 828,022 | 2/1960 | United Kingdom | 52/283 |

OTHER PUBLICATIONS

Engineering News Record; Apr. 19, 1973, p. 28.

*Primary Examiner*—Ernest R. Purser
*Assistant Examiner*—Henry Raduazo

[57] ABSTRACT

A construction for supporting space units installed in a building, especially a multi-storey building, in a statically determinate manner, comprising three vertical columns with suspension means for holding the space units and horizontal beams and horizontal slabs supporting the vertical columns.

4 Claims, 6 Drawing Figures

Figure 1:
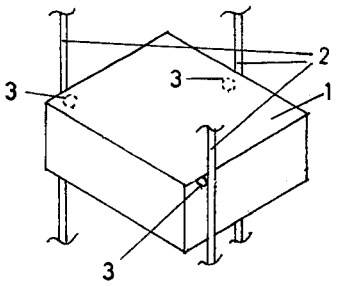

CONSTRUCTION FOR SUPPORTING SPACE UNITS INSTALLED IN A BUILDING ESPECIALLY A MULTI-STOREY BUILDING

RELATED APPLICATIONS

This is a continuation-in-part Patent Application of copending Patent Application, Ser. No. 526,328, filed Dec. 23, 1974 and now abandoned.

The known concept of installing space units in a building, especially a multi-storey building, is based on either placing the individual space units on one another and rigidly connecting the same together or supporting the space units by means of an outer construction.

In order to get a statically determinate system, such outer construction comprising vertical columns would have to be bound by trellis-works or Vierendeel beams. Such a construction, because of the extra material to be used, would be expensive and, besides, a closed space formation would be formed by the extra material filling the space between the columns. In this event an installation of separate space units would be obviously superfluous.

In case that the outer construction is statically undeterminate, that means that the space units are subjected to outer forces created by working loads variably acting on the vertical columns of the outer construction, the space units must have a sturdy construction. This represents with a multi-storey building a big quantity on extra material and consequently a very heavy load on the building.

It is the object of the invention to provide a construction for supporting space units installed in a building, especially a multi-storey building, in a statically determinate manner, by means of which the space units are free from outside forces, and which enables a light construction of the space units.

The construction as per the invention is characterized by three vertical columns embedded in the ground and grouped around said space units in their near proximity, said columns being provided with joints for supportingly accommodating said space units allowing them to variably move in vertical directions when a portion of at least one of said columns is subjected to a vertically acting variable working load, and by horizontal beams and horizontal slabs embedded in the building walls and flexibly connected to one another for taking up laterally acting forces caused by side winds.

A building, especially a multi-storey building, has a construction which takes up wind forces from all directions. Such a construction is conventionally made of trellis-work or wall tube. The construction of a building which takes up the wind forces from only one direction is a wall usually made equally of trellis-works. The construction system according to the invention which is positioned between the conventional constructions taking up the wind forces consists of beams and slabs (solid or of trellis work) embedded in the wind force receiving construction and flexibly connected to one another. Such construction system supports columns supporting space elements. This solution gives the space units the possibility to substantially move in vertical direction, when a portion of at least one column is subjected to a working load acting vertically. This allows further a light construction of such space units. The body sound insulation of the space units can be solved by covering the inner surfaces of the space unit with sound absorbing elements or by providing the joints of the columns on which the space units are disposed with resilient means.

Figure 2:
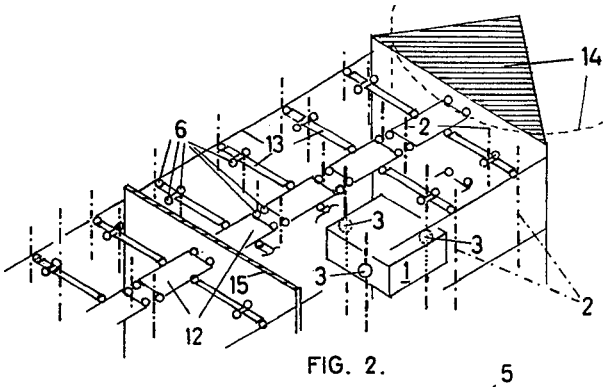
Figure 3:
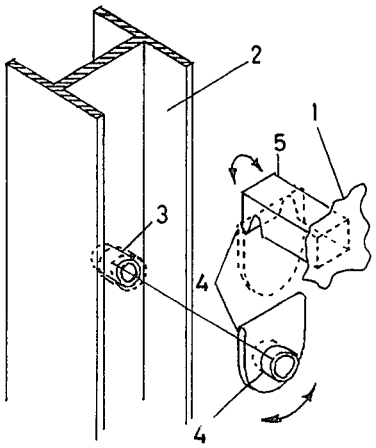
Figure 4:
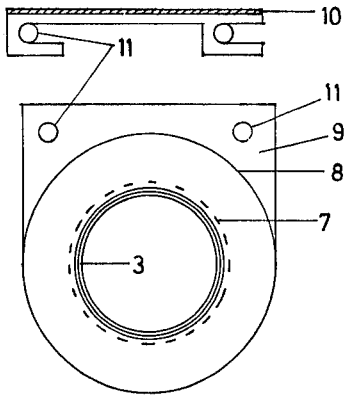
Figure 5:
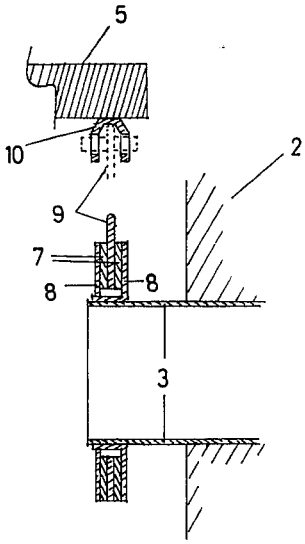
Figure 6:
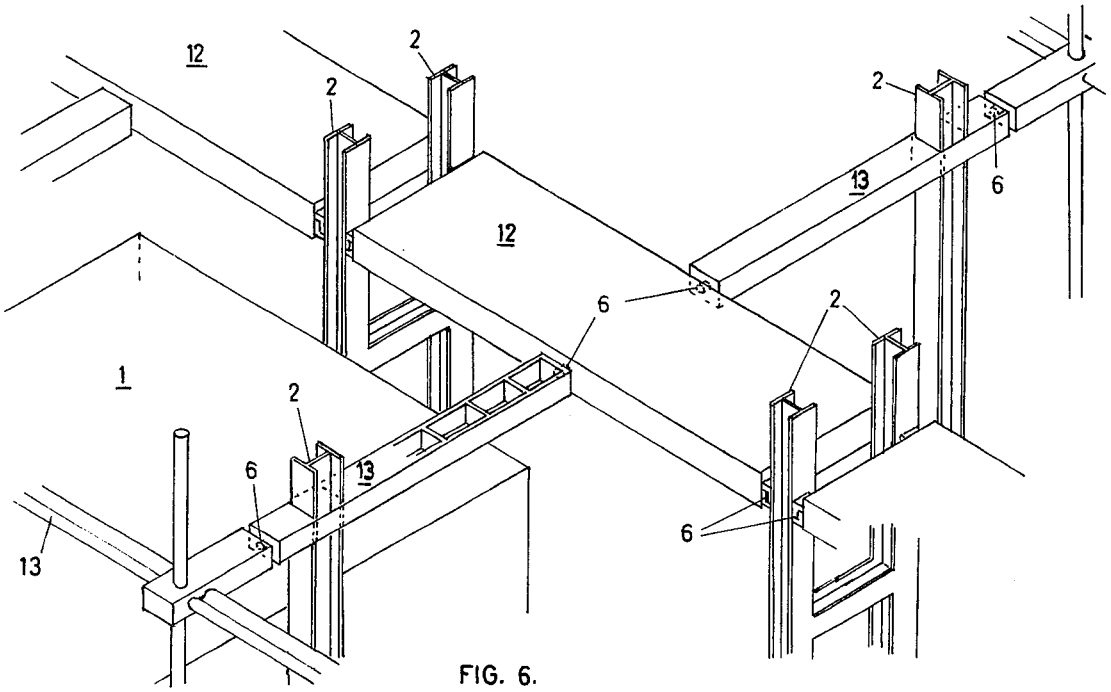

The invention will be described further, by way of example with reference to accompanying drawings in which FIG. 1 is a perspective view on axonometric projection of a space unit suspended on three columns, FIG. 2 is a perspective view on axonometric projection of a space unit the columns of which are supported by beams and slabs embedded in the construction which takes up wind forces, FIG. 3 is a perspective view of a beam with a knocked-down joint, FIG. 4 is a side elevation of another embodiment of a joint, FIG. 5 is a sectional view of the same and FIG. 6 is a perspective view of the beams and slabs according to FIG. 2, to a larger scale.

FIG. 1 shows a space unit 1 supported by three vertical columns embedded in the ground and grouped around the space unit. The columns 2 are in the nearest proximity of the space unit 1 and are built inside a building, especially a multi-storey building, having a construction 14 for taking up wind forces coming from all directions, as it can be seen from FIG. 2. FIG. 2 shows a grouping of several space units out of which only one is depicted. In the construction 14 which takes up wind forces coming from all directions slabs 12 and beams 13 are embedded. As it can be seen from FIG. 2 the construction of the building comprises a wall 15 which takes up wind forces coming only from one direction. The horizontal beams 13 and the horizontal slabs 12 are arranged in right angles to one another and are connected by means of joints 6. The only depicted space unit 1 is suspended on three columns 2 which are marked generally in phantom lines.

As it can be seen in detail in FIG. 3, each column 2 is provided with a tube 3 welded to the same. On the tube 3 threre is mounted a pressing disc with an outer tube 4 on which a sectional piece 5 with groove connected to the space unit 1 is supported. This is a so-called rigid connection. An elastic connection is shown in FIGS. 4 and 5. On a tube 3 there are mounted two pressing discs 8 spaced apart from each other. Two elastic pieces 7 of "Neopren" are inserted between these metal discs 8. A metal disc protruding from the elastic pieces 7 is inserted between these two elastic pieces 7. The protruding metallic piece 9 is provided with two rods 11 on which an U-element 10 is pushed on. The U-element is connected with a sectional piece 5 of a space unit.

The so formed joints enable principally a vertical movement of the suspended space unit 1 when a portion of at least one of the columns 2 is subjected to a vertically acting variable working load. The horizontally arranged beams and slabs take up laterally acting forces caused by side winds so that the space units are practically not effected by either forces acting in right angles to the longitudinal axis of the building or by a vertically acting variable working load causing subsidences of the columns.

For this reason the space units can be built of light material; their suspension on the columns can be rigid or elastic.

What is claimed is:

1. A construction for supporting space units installed in a multi-storied building, in a statically determinate manner, characterized by only three vertical columns embedded in the ground and grouped around and adjacent to each said space unit, said columns being provided with joints for supporting said space units in such a way as to allow them to move variably in a vertical direction when a portion of at least one of said columns is subjected to a vertically acting variable working load; and by horizontal beams and horizontal slabs that are embedded in vertical constructions which take up wind forces, said beams and slabs being connected to one another in such a way as to allow relative vertical movement of the columns and also the turning of the space units in all directions while preventing lateral movement due to wind forces.

2. The construction as claimed in claim 1 characterized in that each said joint comprises a horizontal tube fixed to said column and a disc mounted on said tube on which disc a force transmitting mounting piece of said space unit is disposed.

3. The construction as claimed in claim 2, characterized in that the disc comprises elastic pieces and a metallic disc protruding out of the same to which said mounting piece is attached.

4. The construction as claimed in claim 1, characterized in that said beams and said slabs are arranged at right angles to one another.

* * * * *